US005269487A

United States Patent [19]

Heitzman

[11] Patent Number: 5,269,487

[45] Date of Patent: Dec. 14, 1993

[54] RSTRAINT DEVICE FOR PICTURES AND WALL HANGINGS

[76] Inventor: William B. Heitzman, 40812 Creston, Fremont, Calif. 94538

[21] Appl. No.: 960,728

[22] Filed: Oct. 14, 1992

[51] Int. Cl.[5] ..... A47G 1/16

[52] U.S. Cl. ..... 248/489; 248/493

[58] Field of Search ..... 248/466, 489, 475.1, 248/493, 497, 496, 610, 549, 900; 24/300, 301, 265 H

[56] References Cited

U.S. PATENT DOCUMENTS

| | | | |
|---|---|---|---|
| 454,111 | 6/1891 | Coupe | 248/493 |
| 1,671,280 | 5/1928 | Griffith | 248/610 |
| 1,721,516 | 7/1929 | Jacobs | 24/265 HX |
| 1,858,875 | 5/1932 | Blumenthal . | |
| 2,496,990 | 2/1950 | Downing | 248/493 |
| 3,612,469 | 10/1971 | Dennis | 248/475 R |
| 4,003,539 | 1/1977 | Gutner | 248/489 |
| 4,074,888 | 2/1978 | Garner | 248/475 R |
| 4,458,872 | 7/1984 | Couch | 248/497 |
| 4,595,402 | 6/1986 | Silletto | 248/610 X |
| 4,821,992 | 4/1989 | Johnson | 248/493 |
| 4,919,525 | 4/1990 | Gilbert | 248/549 X |
| 4,967,993 | 11/1990 | Wilson | 248/489 X |

FOREIGN PATENT DOCUMENTS

| | | | |
|---|---|---|---|
| 1234025 | 6/1971 | United Kingdom | 248/549 |

*Primary Examiner*—J. Franklin Foss

[57] ABSTRACT

A flexible link and snap, the function of which is to limit the fall of a wall hanging if the hanging becomes dislodged from its hanger. The device is easily connected and disconnected and does not complicate the aesthetic positioning of the wall hanging.

3 Claims, 4 Drawing Sheets

RSTRAINT DEVICE FOR PICTURES AND WALL HANGINGS

BACKGROUND OF THE INVENTION

1. Field of the Invention

This invention relates to restraint devices and in particular to the restraint of pictures and other wall hangings which might be inadvertently knocked loose from their hangers.

2. Background Art

Heretofore, most devices for mounting pictures were designed to satisfy two needs. These needs are, one, to allow the aesthetic centering of the wall hanging, and, two, to provide easy installation and removal of the wall hanging. In regions of frequent seismic activity it is necessary to satisfy another need. That need is to secure the wall hanging against being jostled into falling. By falling, it might be damaged or might strike and injure a person. Furthermore, in regions of earthquake activity, local governmental agencies recommend secondary securement to prevent injury or damage during seismic activity.

Search for prior art revealed a limited number of devices which attempt to satisfy all three needs. Each of these devices has disadvantages and none has the advantage of providing a redundant securement system. The first identified prior art is U.S. Pat. No. 1,858,875 (Blumenthal) issued May 17, 1932. Blumenthal's device will satisfy the securement criterion cheaply and simply, but only if the hanger nail is sunk into wood. However normally hanger nails are sunk into common drywall. In such circumstances the device fails the securement objective in that the nail can slip out during an earthquake. In any case the device fails the aesthetic criterion. Also it must be completely pulled from the wall in order to remove the picture.

U.S. Pat. No. 3,612,469 (Dennis) issued Oct. 12, 1971 is designed to prevent theft and is positively secure against earthquakes, but it is heavy, complex, expensive, time consuming; and the aesthetic hanging of the object is a major task.

Both U.S. Pat. No. 4,074,888 (Garner) issued Feb. 21, 1978 and U.S. Pat. No. 4,458,872 (Couch) issued Jul. 10, 1984 are complex and require meticulous positioning of the hanging apparatus on the picture frame. Failure to exactly center the device would cause the picture to tilt and therefore not hang aesthetically. In such cases reinstallation of the device would be required. This would be frustrating and time consuming.

U.S. Pat. No. 4,821,992 (Johnson) issued Apr. 18, 1989 fails its securement objective because it is secured to the wall with a simple hanger nail. For aesthetic reasons most hanger nails will be mounted into drywall. Drywall offers little resistance to a nail being jostled or pulled out of the wall. Consequently it is possible that this hanger could be jarred free from the wall during an earthquake.

SUMMARY

The present invention is directed toward providing a device which will solve the above described problems by separating the aesthetic hanging function from the seismic securement function. All embodiments of the invention include a strong, pliable tether and means to attach one end of the tether firmly to a wall and the other end of the tether to the picture. In each embodiment of the invention the tether is fitted with a quick release snap to allow easy removal and installation of the picture.

Therefore, it is an object of this invention to provide a simple method for securing a picture or other suspended artifact to a structural member of a building. It is also an object of the invention to permit its easy removal and to not interfere with the aesthetic hanging of the picture.

It is a further object of this invention to provide a securement which is partially or completely redundant to the primary picture hanger.

Figure 1:
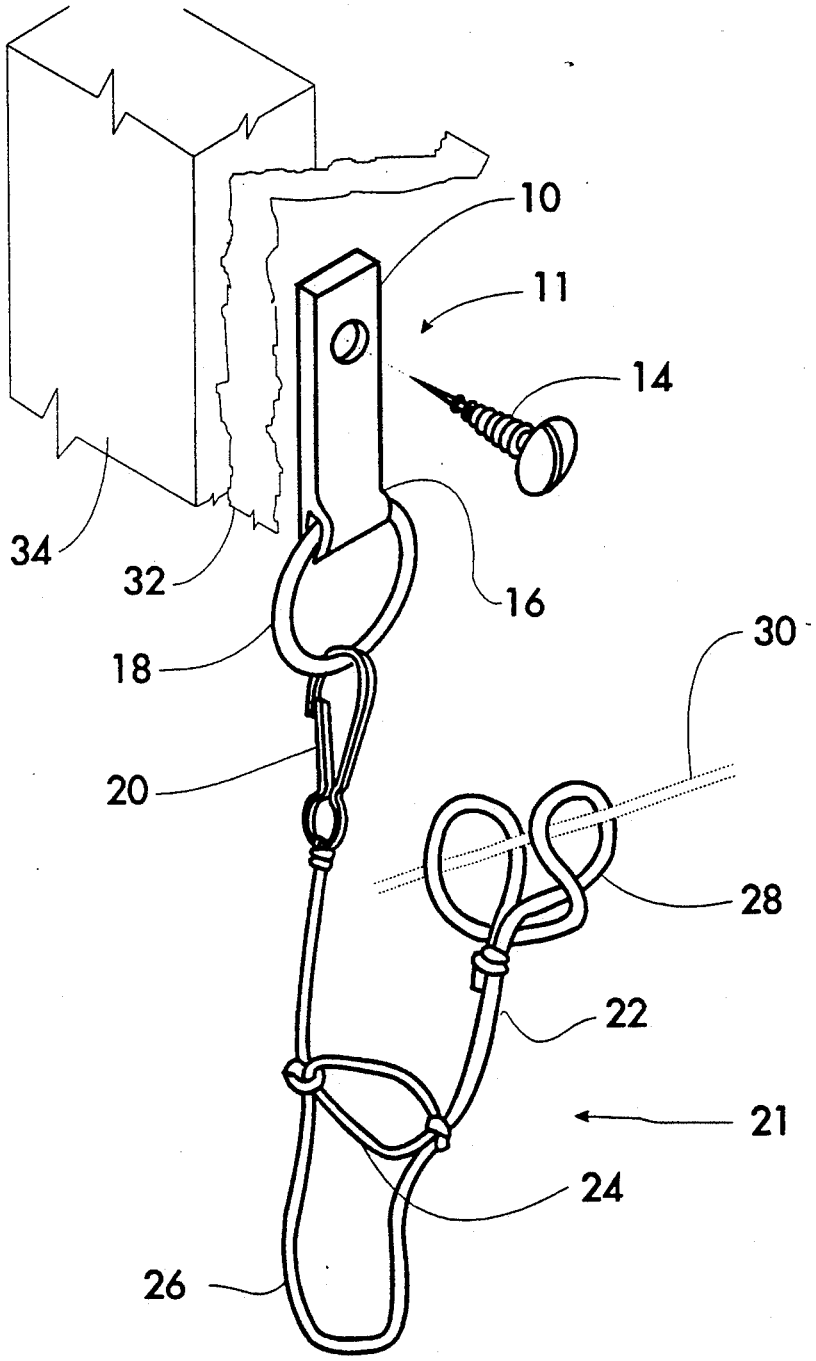
FIG. 1 shows, in perspective, how the preferred embodiment is to be installed.

A List of Reference Numbers for the Figures

10: bracket
11: bracket assembly
12: hole in upper end of bracket
14: lag bolt or heavy screw
16: loose journal
18: dee ring
20: simplex snap
21: tether assembly
22: high strength cord
24: rubber band
26: excess loop in cord
28: noose in cord
30: picture hanger wire
32: dry wall
34: building structural member
36: picture hanger

DESCRIPTION OF THE PREFERRED EMBODIMENTS

Figure 3:
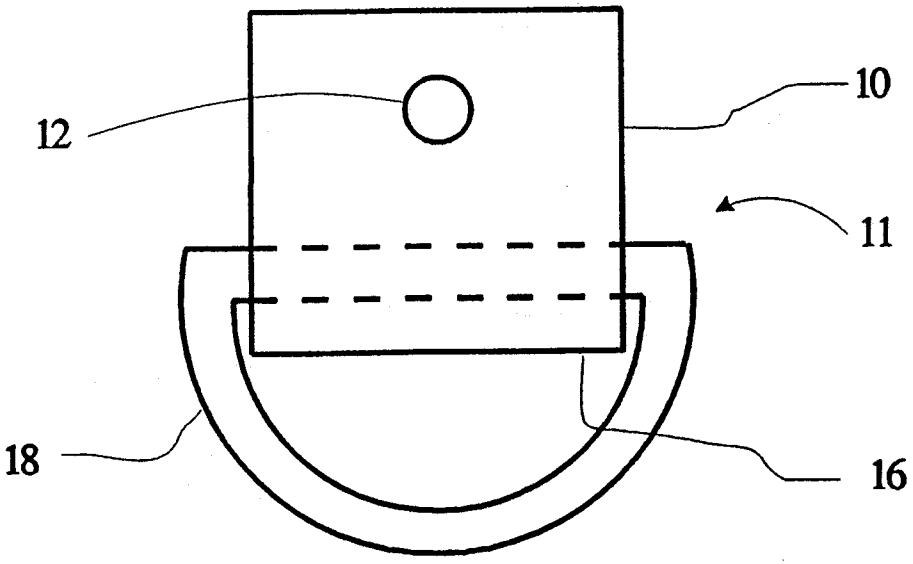
FIG. 3 is a front view of the bracket assembly shown in FIG. 2.
Figure 2:
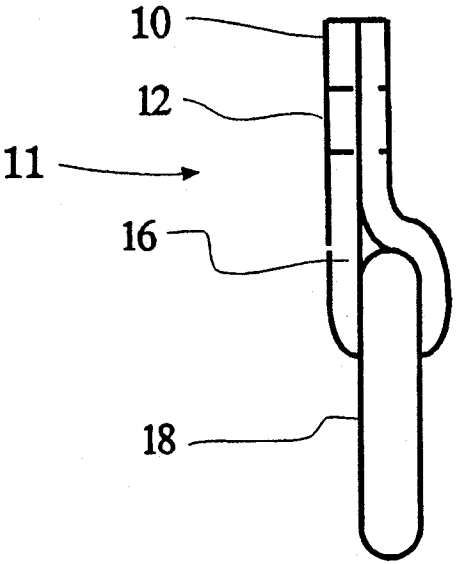
FIG. 2 is a side view of the bracket assembly of the embodiment shown in FIG. 1.

FIGS. 1 through 5 portray the preferred embodiment of the invention. In this embodiment the invention consists of two major assemblies, a bracket assembly 11 and a tether assembly 21. Bracket assembly 11 is illustrated in FIGS. 2 and 3. FIG. 2 is a side view and FIG. 3 is a front view. At one end of a bracket 10 a journal 16 is loosely formed around a dee ring 18. A hole 12 is bored at the other end of bracket 10. As shown in FIG. 1, screw 14 is inserted through hole 12 and used to mount bracket assembly 11 to a building structural member 34. Screw 14 is heavy enough and long enough to penetrate a typical drywall sheet 32 and into structural member 34. Neither sheet 32 nor member 34 are part of this invention. In the embodiment illustrated all the components are made of metal, however any material can be used so long as the material has sufficient strength for the duty intended. Leather, plastics, nylon, vinyl and other natural and synthetic materials can be used to make dee ring 18 or bracket 10, provided strength is considered.

Figure 4:
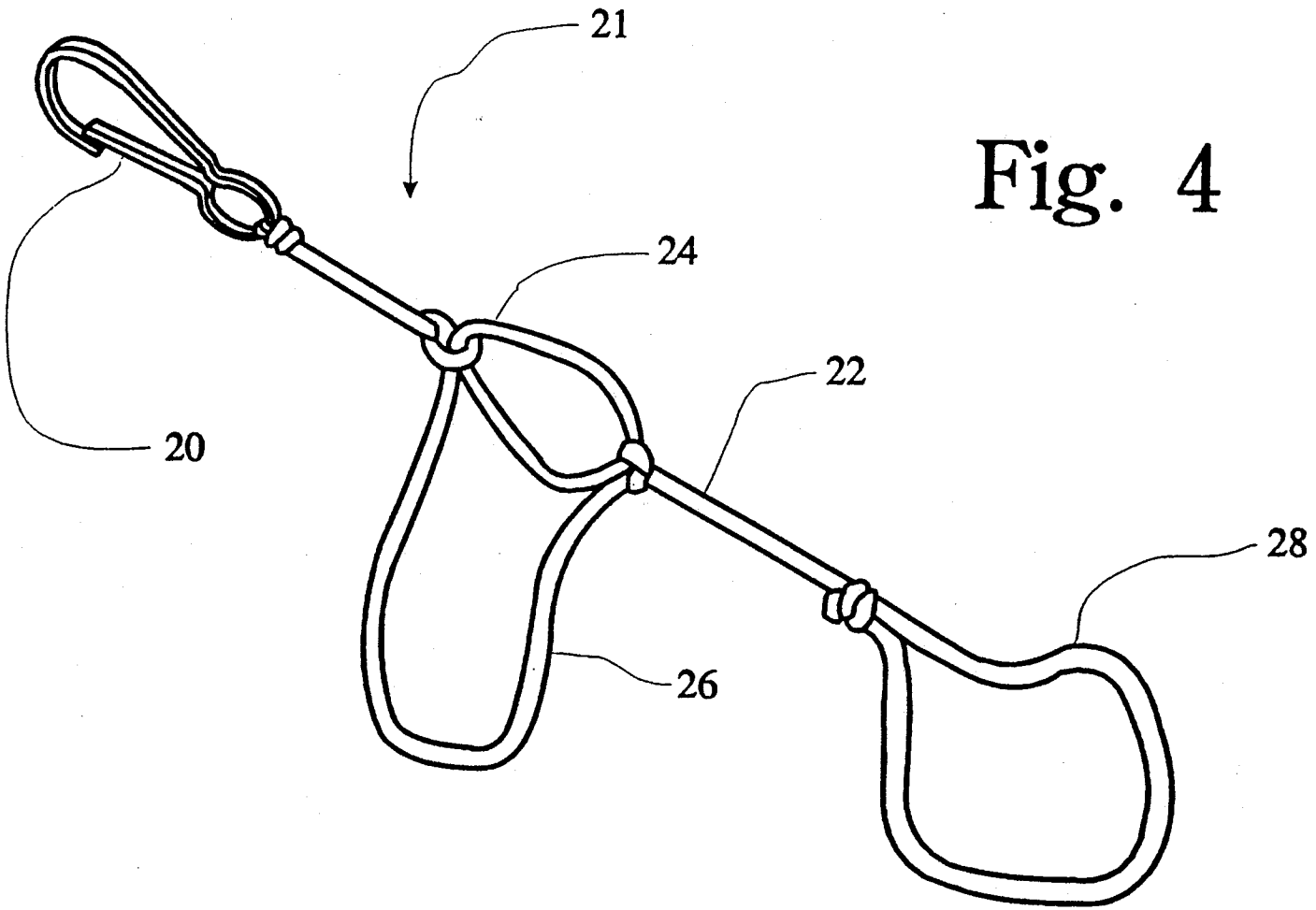
FIG. 4 is a perspective view of the tether assembly of the embodiment shown in FIG. 1.
Figure 5:
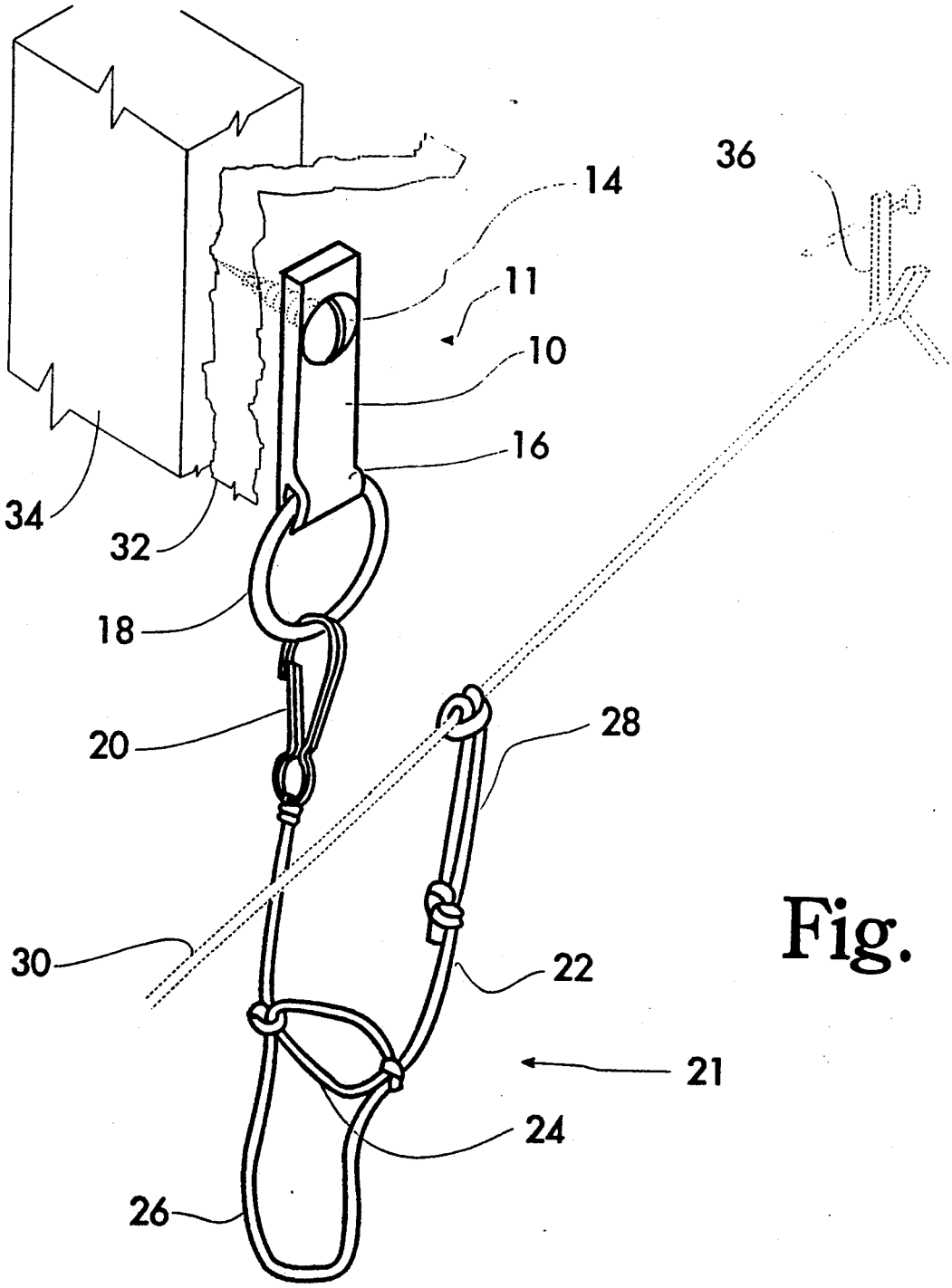
FIG. 5 is a perspective view of a properly installed FIG. 1 embodiment.

FIG. 4 portrays the preferred embodiment of tether assembly 21. The main body of tether assembly 21 is a high strength cord 22. A simplex snap 20 is attached to one end of cord 22. A slip noose 28 is constructed at the other end of cord 22. Tether assembly 21 is attached to a picture hanger wire 30 by looping noose 28 around wire 30, and then carefully pulling tether assembly 21 through noose 28. As shown in FIG. 1, this will entrap picture hanger wire 30 in noose 28. Snap 20 is then pulled until noose 28 lightly grips wire 30. Once the picture is put in place snap 20 is attached to ring 18. When the invention is properly completed, cord 22 will not be in tension while the weight of the picture is hanging from picture hanger 36. FIG. 5 portrays the completed installation of the embodiment.

In the preferred embodiment of tether assembly 21, a shock dampener is formed by attaching a strong rubber band 24 across an excess loop 26 of cord 22 as shown in FIG. 4. Other embodiments can be made without a shock dampener.

For pictures or wall hangings which are less than 16 inches wide, there may be no structural member directly behind the picture. If no structural member is behind the picture, the invention cannot both be aesthetically hidden behind the picture and also attached firmly to a structural member. In such case an embodiment of the invention can be mounted using a hollow wall fastener. Hollow wall fasteners are well known in the art.

In all embodiments, the invention serves as a well secured tether to limit a fall of a picture or wall hanging should the picture be dislodged from its picture hanger. The use of rubber band 24 further protects the picture by dampening out the shock to the picture as the tether goes into tension to break the picture's fall. In all embodiments, the invention allows easy attachment and detachment from the picture and does not inhibit or complicate the aesthetic positioning of the picture.

While specific embodiments of my invention have been shown and described, it will be apparent to mechanics skilled in the art that variations may be made without departing from the spirit and the scope of my invention. Thus, the scope of the invention should be determined by the appended claims, rather than by the examples given.

I claim:

1. A device to restrain a picture or wall hanging, comprising:

a) a tether comprising a snap connector attached to one end of a pliable linkage which is less than twelve inches in length, and a slip noose constructed into the other end of said linkage, said noose providing means to tightly grip a picture hanger wire, and b) a bracket having a means for connecting said bracket to a wall and a means for attaching said snap connector of said tether, and c) wherein an elastic material is attached across an excess loop of said linkage thereby providing means for dampening the shock of a fall of said picture.

2. The device of claim 1 wherein said pliable linkage is composed of textile material.

3. The device of claim 2 wherein said bracket means for attaching said snap connector of said tether is a journaled dee ring.

* * * * *